US005735663A

United States Patent [19]

Zachhuber

[11] Patent Number: 5,735,663

[45] Date of Patent: Apr. 7, 1998

[54] WASTE COLLECTION SYSTEM

[76] Inventor: Kurt Zachhuber, Heubergstrasse 4, D-83026, Rosenheim, Germany

[21] Appl. No.: 730,243

[22] Filed: Oct. 15, 1996

Related U.S. Application Data

[63] Continuation of PCT/EP95/01320 Apr. 11, 1995.

[30] Foreign Application Priority Data

Apr. 15, 1994 [DE] Germany ..... 44 13 103.8

[51] Int. Cl.[6] ..... B65F 3/02

[52] U.S. Cl. ..... 414/338; 414/406; 414/419; 414/420

[58] Field of Search ..... 414/337, 338, 414/406, 408, 419, 421, 420

[56] References Cited

U.S. PATENT DOCUMENTS 3,576,265 4/1971 Brady .
3,845,868 11/1974 Myers ..... 414/338

FOREIGN PATENT DOCUMENTS 0170603 6/1985 European Pat. Off. .
6810636 4/1969 Germany .

*Primary Examiner*—Thomas J. Brahan
*Attorney, Agent, or Firm*—Helfgott & Karas, PC.

[57] ABSTRACT

A waste collection system comprises a waste receptacle (1) and a collection vehicle (2) suitable for the mechanical emptying thereof. The waste receptacle (1) is suspended from a supporting frame (3) by way of a swivel bearing (22) so as to swivel around a horizontal axis (5), and the collection vehicle (2) includes a catch basin (13) into which the waste receptacle is emptied when it is swiveled out of its upright position, when the collection vehicle drives past said receptacle and guides the catch basin under the waste receptacle. The swivel bearing (22) is allowed to freely swing the waste receptacle through its upright position, and the collection vehicle features a tipping mechanism for the waste receptacle (1), which includes a grip element (10) that takes hold of a projection or the rim (11) of the inclined waste receptacle (1) and turns it upside down.

8 Claims, 5 Drawing Sheets

WASTE COLLECTION SYSTEM

This is a continuation of application Ser. No. PCT/EP94/01320 filed on Apr. 11, 1995.

The present invention relates to a waste collection system comprising a waste receptacle and a collection vehicle suitable for the mechanized emptying thereof, whereby the waste receptacle is suspended from a supporting frame by way of a swivel bearing so as to swivel around a horizontal axis, and the collection vehicle includes a catch basin into which the waste receptacle is emptied when it is swiveled out of its upright position, when the collection vehicle drives past said receptacle and guides the catch basin under the waste receptacle. The invention further relates to a corresponding collection vehicle as such.

Such a waste collection system is known from U.S. Pat. No. 3576265. To empty the waste receptacle, it is placed in an inclined position by a swivel projection of the collection receptacle that is pushed along under it and is located under the level of the swivel bearing. In this way, a side panel suspended from its upper edge swings open and provides a side aperture for emptying the waste receptacle. If the collection receptacle continues to pass under the inclined waste receptacle, the latter falls back into its upright position under its own weight, whereby the side panel closes.

From the German utility models G6810636, 7701229, and 8509763, other waste receptacles are known that are suspended from a supporting frame by way of a swivel bearing so as to swivel around a horizontal axis. The purpose of the bearing of the waste receptacle, which can be swung 180° from the respective supporting frame, is to facilitate the manual emptying of the waste receptacle. This is because the waste receptacle can simply be swung 180° ("turned upside down") in order to empty into a collection receptacle positioned under it.

The waste collection system known from U.S. Pat. No. 3576265 demonstrates a number of disadvantages. First of all, it is not possible for the collection vehicle to alternately drive past the waste receptacle in either direction in order to empty it; instead, the waste receptacle can be emptied only with one specified direction of travel by the collection vehicle. This means that the later route of the collection vehicle for its emptying runs must already be established when setting up the waste receptacle. In addition, manufacturing and stock-keeping are made more difficult by the fact that various configurations of waste receptacles must be manufactured and kept on hand. A further disadvantage is the occasionally unsatisfactory residual emptying. Especially disturbing, moreover, is the loud impact noise that occurs when the waste receptacle is returned to its upright position after emptying. The impact of the waste receptacle falling back against a catch can also result in damage to the supporting frame, especially to the swivel bearing.

The problem of the present invention is to create a generic waste collection system that does not demonstrate the disadvantages described above. In particulars good residual emptying, flexibility in laying out the emptying route, and durability of the components should be ensured.

According to the present invention, this problem is solved by allowing the swivel bearing supporting the waste receptacle to freely swing the waste receptacle through its upright position and by installing on the collection vehicle a tipping mechanism for the waste receptacle, which includes a grip element that takes hold of a projection or the rim of the inclined waste receptacle and turns it upside down. In the waste collection system according to the invention, the collection vehicle for emptying the waste receptacle can be driven past it from both directions. In so doing, the swivel projection of the catch basin is first moved up to the waste receptacle, below its horizontal swivel axis. In this way, the waste receptacle is placed in an inclined position. When the collection vehicle is moved further, the grip element takes hold of the rim of the inclined waste receptacle or of a suitable projection positioned under the rim of the waste receptacle. With continued motion by the collection vehicle, the waste receptacle is further swiveled and tipped by the grip element, so that it is "turned upside down" over the catch basin of the collection vehicle, which is open at the top; i.e., it is swung 180° relative to its original (upright) position. In this way, all of the waste collected in the waste receptacle is emptied into the catch basin of the collection vehicle. Once emptying is complete, the collection vehicle can be moved backwards. In an especially preferred embodiment of the invention, however, the collection vehicle is configured in such a way that with continued motion by the collection vehicle the catch basin can pass all the way through under the "upside down" waste receptacle. In this case, waste collection is especially economical, since the collection vehicle need not be brought to a stop while emptying the waste receptacle. If the suspension of the waste receptacle from the supporting frame features no catch defining the upright position, then not only the collection vehicle can pass by the waste receptacle in alternating directions in order to empty it [sic]. In addition, there is no disturbing impact noise when the waste receptacle falls back into its upright position; moreover, this spares the swivel bearing from damage.

Thus, in the waste collection system according to the invention the upright position of the waste receptacle is defined solely by the equilibrium point at which the center of gravity of the waste receptacle is located under the swivel bearing.

A preferred embodiment of the collection vehicle according to the invention features a shaking mechanism for the upside-down waste receptacle. One especially simple configuration of the shaking mechanism consists of a waved guide track for the rim of the waste receptacle. When the collection vehicle is moved, the waste receptacle is shaken by the fact that the rim is sliding along the waved guide track. This loosens any waste that is sticking to the interior wall of the waste receptacle.

The catch basin of the collection vehicle can function simultaneously as a collection receptacle. In one especially preferred embodiment of the invention, however, the catch basin is connected to a separate collection receptacle by way of a conveyor. This opens up the possibility of selecting the size of the collection receptacle independently of the height of the swiveling suspension of the waste receptacle. Because of the larger configuration of the collection receptacle, a correspondingly larger number of waste receptacles can be emptied before the collection receptacle of the collection vehicle must itself be emptied. Moreover, aside from the feed aperture for the conveyors, the collection receptacle can be completely closed; this is preferable for hygienic reasons.

The collection receptacle of the collection vehicle according to the invention can especially include a commercially standard garbage bag that is attached to an appropriate holding device of the collection vehicle. Such a garbage bag can be removed from the collection vehicle when it is full after emptying a corresponding number of waste receptacles, and then be closed and prepared to be carried away by a transport vehicle.

A waste collection system configured in this way is especially suitable for use in large parks. In particular, in such cases the collection vehicle can also be configured as a self-propelled vehicle.

In a further preferred embodiment of the waste collection system according to the invention, the swivel bearing with which the waste receptacle is suspended from the respective supporting frame is positioned in a vertical guide track of the supporting frame so that it can be lifted, and the collection vehicle includes a lift mechanism for lifting the waste receptacle. In a waste collection system developed in this way, the catch basin of the collection vehicle can be positioned higher than is the case with waste receptacles lacking a lift bearing, and this height difference is equal to the distance that the waste receptacle can be lifted in the vertical guide track of the supporting frame. With a catch basin of the collection vehicle that has been enlarged to this extent, it is sometimes possible to forego a separate collection receptacle, i.e., the catch basin also serves as the collection receptacle. This permits a structural simplification of the collection vehicle compared to the vehicle described above, in which a separate collection receptacle is connected to the catch basin by way of a conveyor.

One particularly simple possibility for the configuration of the lift mechanism of the collection vehicle is an inclined guide surface on which the inclined waste receptacle slides and on which it is pushed up upon forward motion by the collection vehicle. Alternatively or supplementally, for example, a continuous conveyor in the form of a conveyor belt or a chain conveyor can be provided in order to lift the waste receptacle before it is turned upside down for emptying.

The vertical guide track of the supporting frame can be configured in the form of a telescope. As an alternative to this, a guide rail with a sliding block fed into it can be considered in particular. It is also possible to provide a slotted guide track on the waste receptacle, in which a bearing block affixed to the supporting frame is fed.

The supporting frame for the waste receptacle of the waste collection system according to the invention can be configured both for a ground-mounted and for a wall-or table-mounted waste receptacle. The only essential consideration is that access to the correspondingly suspended waste receptacle is offered for the collection vehicle according to the invention.

In one embodiment of the invention, the waste receptacle is mounted on the supporting frame with a quick-mounting device. This makes it possible to quickly remove the waste receptacle and clean it with water if necessary. The quick-mounting device can preferably be opened and locked with a key in order to rule out unauthorized activity.

The collection vehicle provided for in the context of the invention can additionally be equipped with a swivel mechanism with which waste receptacles located at the end of a "cul-de-sac," and thus through which the collection vehicle cannot pass, can be emptied into the receiving receptacle. Such a swivel mechanism includes in particular a swivel arm that is mounted on the collection vehicle so as to swivel around a horizontal axis. The free end of the swivel arm features a grip mechanism that takes hold of the waste receptacle to be emptied.

The invention is explained in greater detail below based on the drawings.

Figure 1:
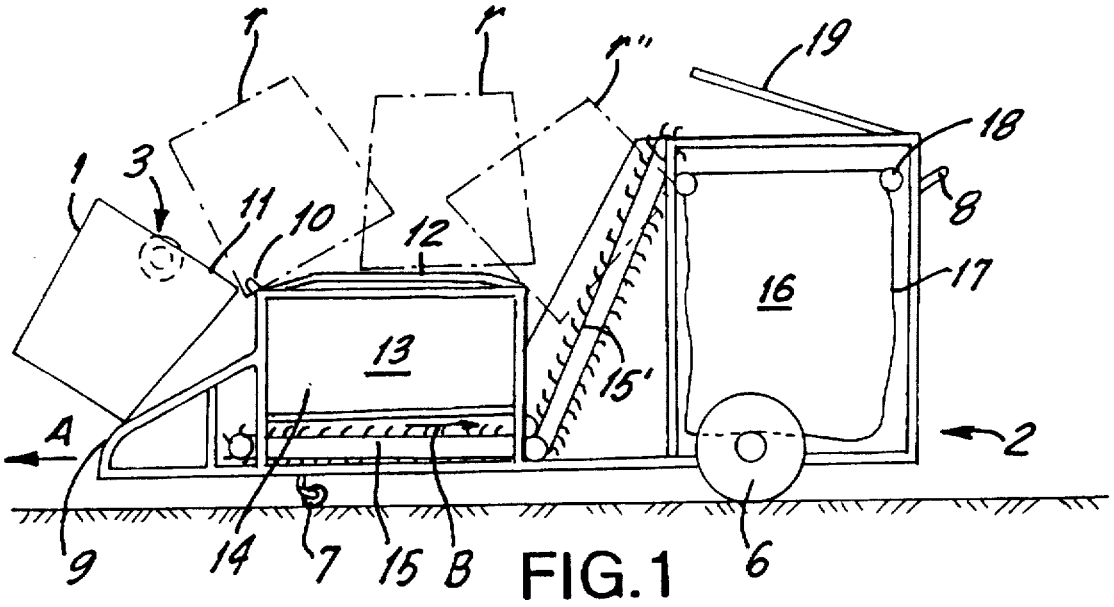
FIG. 1 shows a first embodiment of the waste collection system according to the invention with a wall-mounted waste receptacle.
Figure 2:
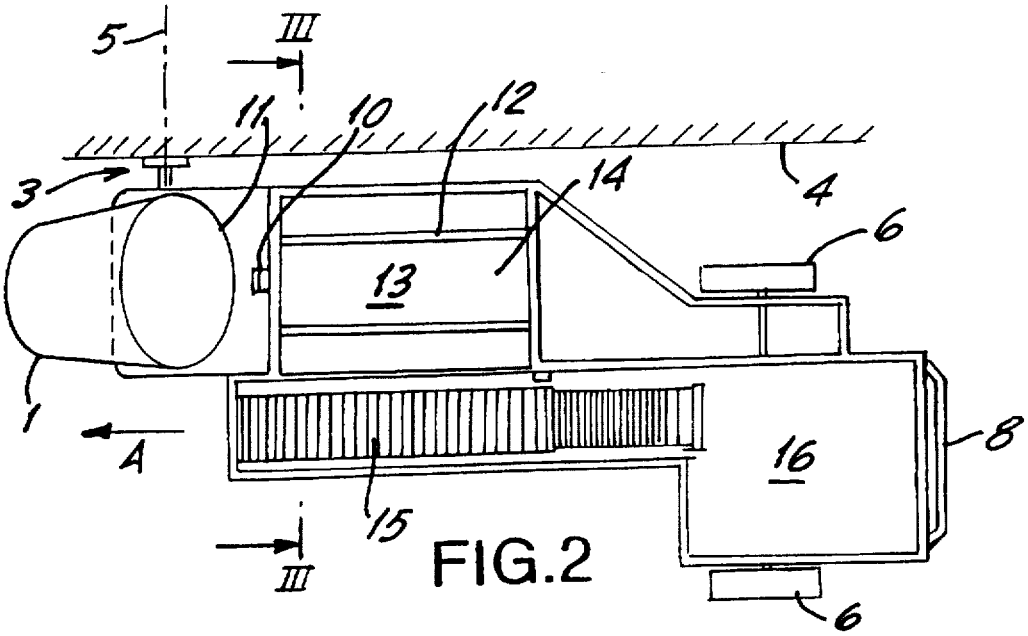
FIG. 2 shows a horizontal projection of the waste system depicted in FIG. 1.
Figure 3:
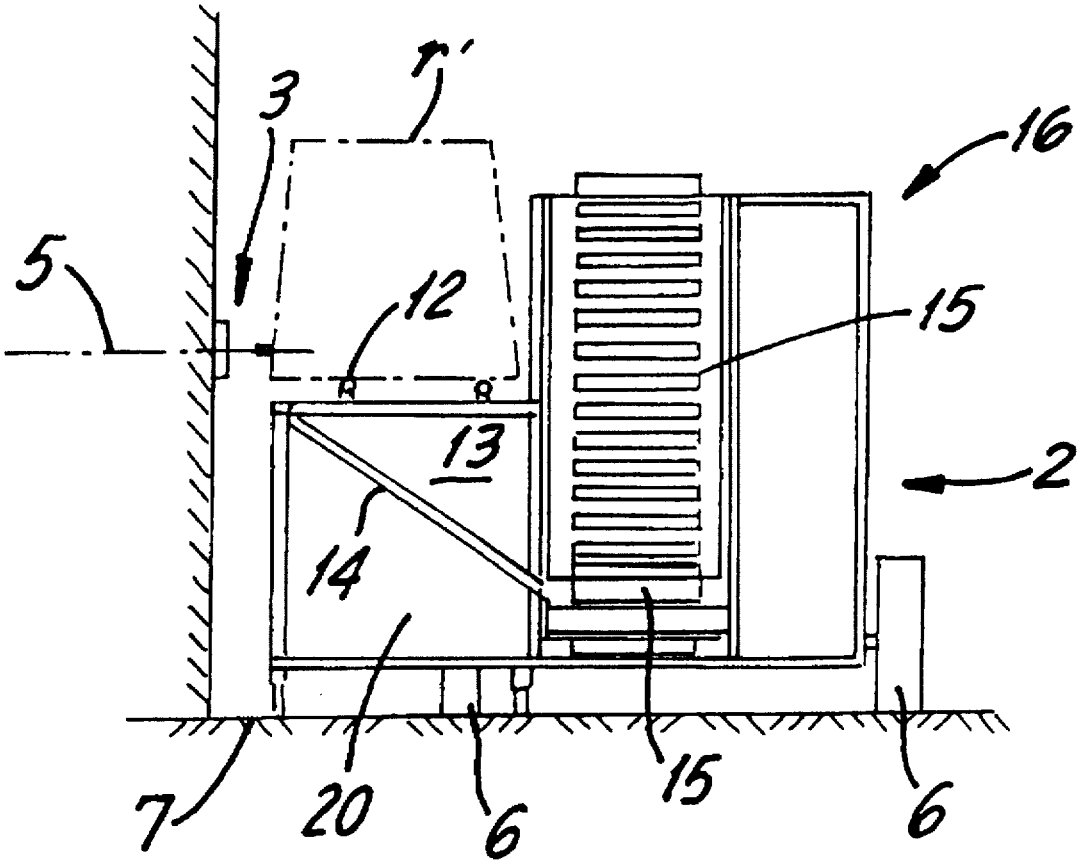
FIG. 3 shows a profile along the line III—III in FIG. 2.

The waste collection system depicted in FIG. 1 through 3 comprises a waste receptacle 1 and a collection vehicle 2. The waste receptacle 1 is mounted on the wall 4 by a supporting frame 3. The supporting frame 3 here includes a swivel bearing that makes it possible to swing the waste receptacle around the horizontal swivel axis 5, which is perpendicular to the wall 4.

The collection vehicle 2 is of tubular frame construction and has two rear wheels 6 and two front wheels 7, whereby the front wheels are configured as steering rollers. In order to push the collection vehicle in its direction of travel (Arrow A), a handle 8 is provided on its rear.

On the front of the collection vehicle 2 is a nose-shaped swivel projection 9. When the collection vehicle is moved in the direction of the waste receptacle 1, this strikes the bottom area of the waste receptacle 1. If the collection vehicle continues moving in its direction of travel (Arrow A), the bottom area of the waste receptacle I is lifted by the swivel projection 9, which causes the waste receptacle to swing around the swivel axis 5. In the position of the waste receptacle 1 depicted in FIG. 1 and 2 with unbroken lines, the hook-like grip element 10 of the collection vehicle makes contact with the rim 11 of the waste receptacle 1. The grip element 10 takes hold of the rim 11 of the receptacle; and as the collection vehicle continues moving in its direction of travel, the receptacle is swiveled around the axis 5 until the receptacle assumes the almost entirely tipped position identified by reference number 1' and depicted with dash-dot lines.

If the collection vehicle 2 is pushed further, the rim 11 of the collection receptacle comes to rest on the two guide struts 12. Through this, the waste receptacle assumes its "upside-down" position 1", rotated 180° and depicted with dash-dot lines. In so doing, the grip element 10 loses contact with the rim 11 of the waste receptacle.

In the upside-down position 1" of the waste receptacle, its contents fall into the catch basin 13 of the collection vehicle 2. The bottom of the catch basin 13 consists of a chute 14 in which the caught contents of the waste receptacle slide laterally onto a conveyor belt 15. The conveyor belt 15 is driven by the rear wheels 6 of the collection vehicle 2 in such a way that with continued movement of the collection vehicle in the direction of travel (Arrow A), it transports the waste lying on it to the collection receptacle 16. To that end, the conveyor belt features a sharply rising section 15' between the catch basin 13 and the collection receptacle 16.

Located in the collection receptacle 16 is a garbage bag 17 which is detachably affixed to a mounting stay 18 in a known configuration. The collection receptacle 16 is closed by a cover 19 that has only an opening for receiving the waste transported on the conveyor belt 15' into the garbage bag 17.

Figure 6:
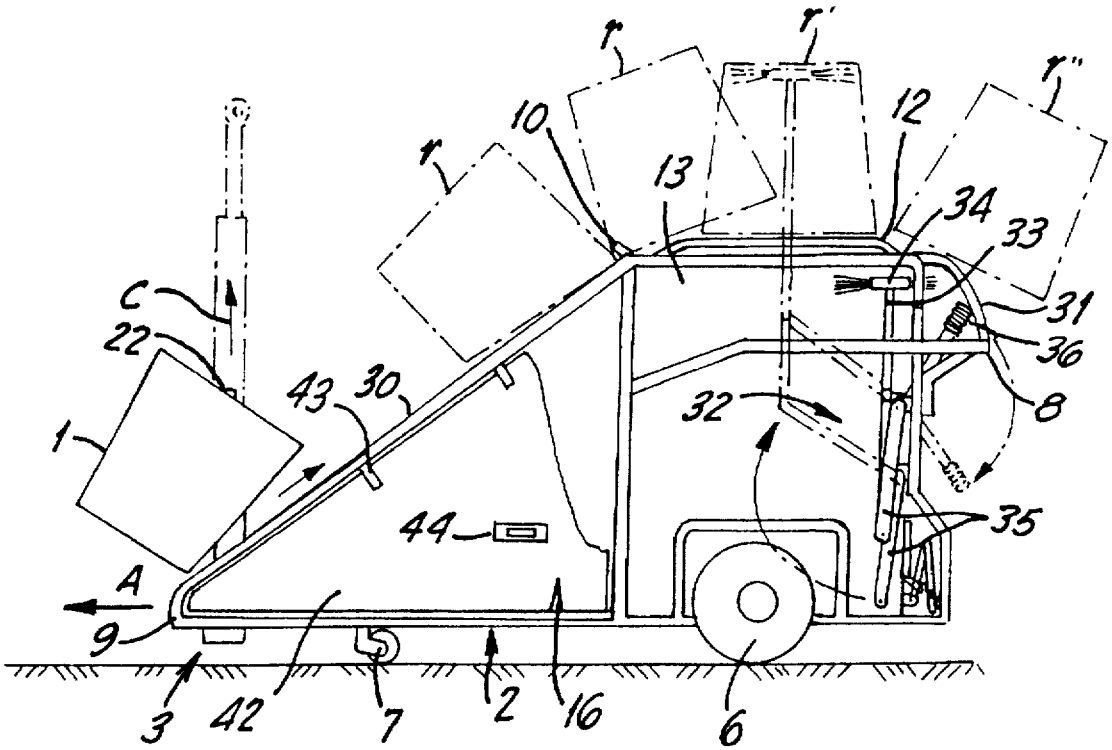
FIG. 6 shows a lateral view of another preferred embodiment of the waste collection system according to the invention.
Figure 6A:
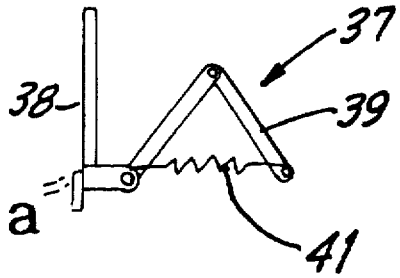

If the collection vehicle 2 continues to move forward after the waste accumulated in the waste receptacle has fallen from it into the catch basin 13, the waste receptacle tips further once the guide struts 12 end, finally assuming its normal position of hanging freely from the wall mount 3; an intermediate position is indicated in FIG. 6 with reference number 1'.

If the garbage bag 17 is full, it can be removed from the collection receptacle 16 of the collection vehicle after its rim has been released from the mounting stay 18. A fresh, empty garbage bag can then be clamped to the mounting stay 18. The storage area 20 for unused trash bags and other tools, located under the chute 4, can be observed in FIG. 3.

Figure 4:
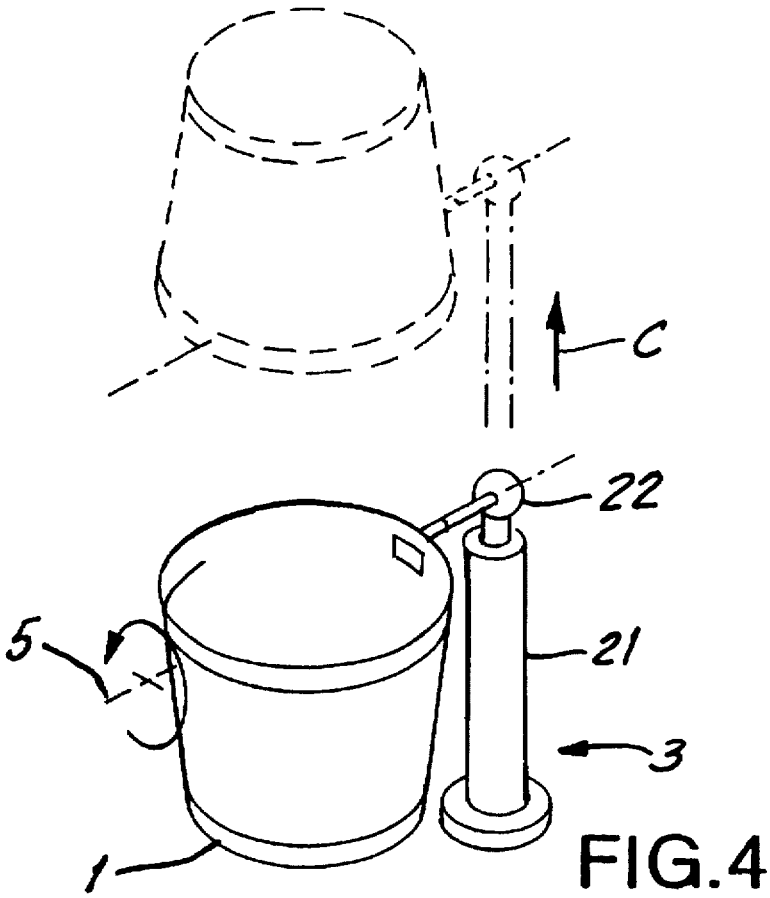
FIG. 4 shows a preferred form of a waste receptacle that can be used in the waste system according no the invention.

Unlike in FIG. 1 through 3, where the supporting frame 3 for the waste receptacle 1 is configured as a wall mounting, in FIG. 4 the supporting frame 3 is configured as a ground mounting. In this case, the supporting frame 3 includes a vertical, telescopically extendable post 21. Because of the telescopability of the post 21, the swivel bearing 22, which permits the waste receptacle 1 to swing around the horizontal axis 5, can be lifted up vertically (Arrow C).

Figure 5:
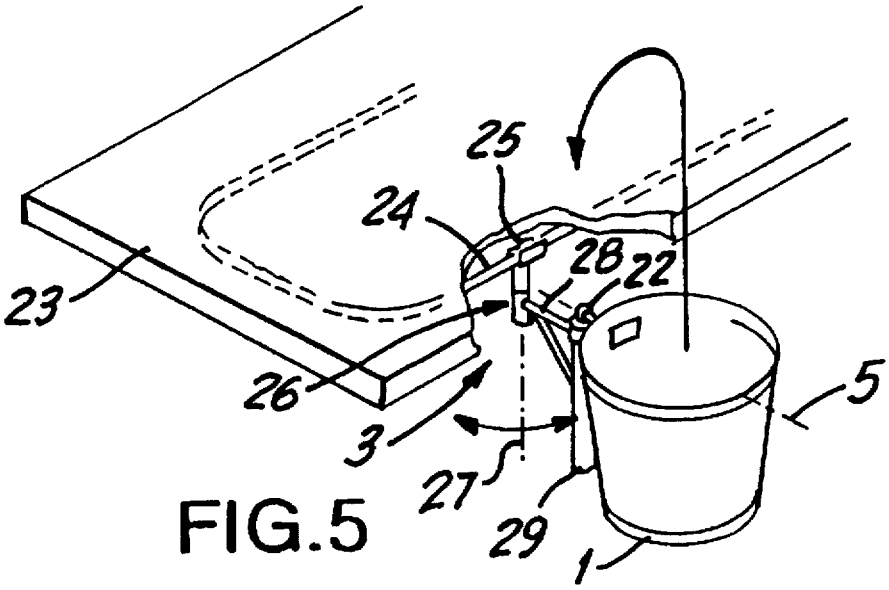
FIG. 5 shows another preferred embodiment of the waste receptacle provided for in the waste collection system according to the invention.

The supporting frame 3 for the waste receptacle 1 depicted in FIG. 5 constitutes a table mounting. To this end, a support rail 24 is provided under the table surface 23. The supporting frame 3 can be firmly affixed to this at any position using a clamp-type socket 25. Attached to a swivel joint 26 with a vertical swiveling axis 27 is an arm 28, which in turn bears the tube 29. Corresponding to the manner described in connection with FIG. 4, the swivel head 22 is positioned at the upper end of a rod that is fed into the tube 29 in a vertical direction and can slide telescopically. In this way, the waste receptacle 1, just as in the case of the supporting frame in FIG. 4, can be raised vertically before it is swiveled around the axis 5. The advantage of having the swivel joint 28 [sic] in a vertical guide track will be described below with reference to FIG. 6 and 7.

Figure 7:
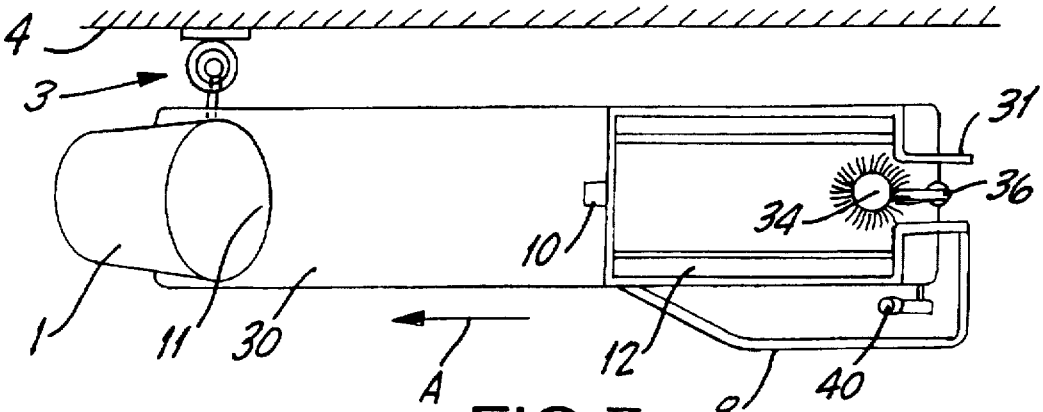
FIG. 7 shows a horizontal projection of the waste collection system depicted in FIG. 6.

The waste collection system depicted in FIG. 6 and 7 comprises—as explained in connection with FIG. 1 through 3 —a waste receptacle 1 and a collection vehicle 2. The collection vehicle 2 depicted in FIG. 6 and 7 is also intended to be driven under the waste receptacle, whereby the waste receptacle dumps its contents into a catch basin 13 of the collection vehicle while temporarily in an "upside-down" position 1" In this case, however, the collection vehicle is specially designed for waste receptacles where the supporting frame 3 permits upward vertical displacement of the swivel bearing 22 (cf. FIG. 4 and 5).

When the collection vehicle 2 is driven against the waste receptacle 1 with its nose-shaped swivel projection 9 in the direction of travel (Arrow A), the receptacle assumes an increasingly inclined position, until the wall of the waste receptacle comes to rest on the inclined guide surface 30. When the collection vehicle 2 is moved further, the waste receptacle slides upward on the guide surface 30 and is thus lifted vertically in the vertical guide track of the supporting frame 3 (Arrow C). When the hook-like grip element 10 takes hold of the rim 11 of the waste receptacle, the process described in connection with FIG. 1 through 3 is repeated; i.e., the waste receptacle is turned "upside down" (Position 1") under the effect of the grip element 10 and empties its contents into the catch basin 13 in this position, with its rim 11 resting on the guide struts 12. If the collection vehicle continues further, the waste receptacle (Position 1") slides down and back on the guide tracks 31 and finally assumes its original position.

Inside the catch basin 13 is a cleaning device 32 for the upside-down waste receptacle 1". This cleaning device includes a broom 34 positioned at the upper end of a rod 33. The rod 33 can be raised using a parallelogram bar assembly 35 in such a way that the broom 34 enters the upside-down waste receptacle. In so doing, the parallelogram bar assembly 35 is operated by way of the grip handle 36.

The collection vehicle 2 has a collection receptacle 16 located in front of the catch basin 13 in the direction of travel. At regular intervals, the waste collected in the catch basin 13 is moved into the collection receptacle 16 by way of a slide mechanism 37. The slide mechanism here includes a slide 38 actuated by a lever bar assembly which is in turn operated by way of a foot pedal 40. A spring 41 returns the slide 38 to its base position.

The collection receptacle 16 is closed by a flap 42. This flap is attached to the frame of the collection vehicle with hinges 43. In order to empty the collection receptacle 16, the flap 42 is lifted by the handle 44 so that the waste can be removed laterally from the collection receptacle 16.

Figure 8:
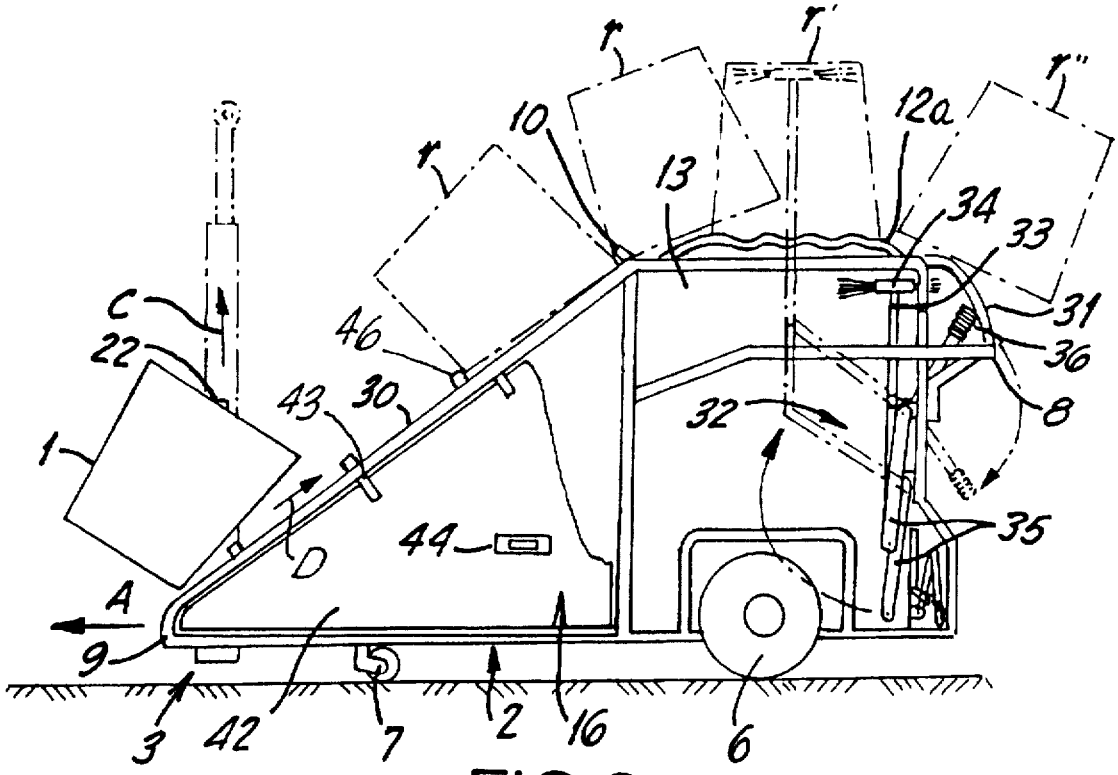
FIG. 8 and 9 show a modification of the waste collection system depicted in FIG. 6 and 7.
Figure 9:
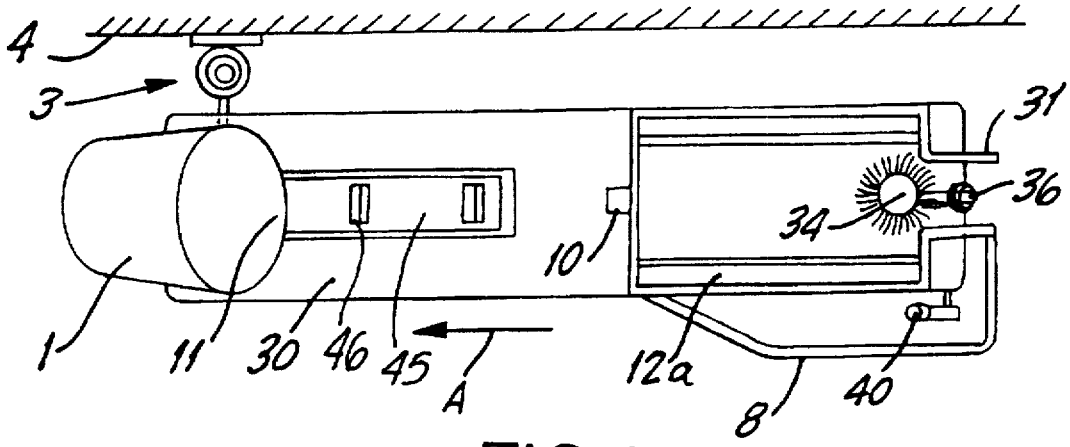

In terms of basic design, the waste collection system depicted in FIG. 8 and 9 is similar to the waste collection system described above and depicted in FIG. 6 and 7. Insofar as the same reference numbers are indicated in FIG. 8 and 9 as in FIG. 6 and 7, they refer to the same parts. To avoid repetition, the following description relates only to those aspects in which the waste collection system according to FIG. 8 and 9 differs from the one according to FIG. 6 and 7.

Incorporated into the guide surface 30 is a conveyor belt 45, which features ribs 46 that protrude above the guide surface. The conveyor belt 45 revolves around two guide rollers in a known manner, one of which is connected to one of the rear wheels 6 by way of a chain drive. Thus, speed transmission is present between the rear wheel 6 and the guide roller connected to it. The connection between the corresponding rear wheel 6 of the collection vehicle and the guide roller driven by it is such that when the collection vehicle moves forward (Arrow A), the strand of the conveyor belt 45 provided in the area of the guide surface 30 is moved up and back (Arrow D).

By way of the ribs, the waste receptacle 1 is moved back and up along the slide surface 30. To this end, one of the ribs grips the lower edge of the waste receptacle 1 and takes hold of it. When the waste receptacle 1, after its upper rim is seized by the hook-like grip element 10, is further swiveled, the corresponding rib 46 loses contact with the lower edge of the waste receptacle.

Unlike the guide struts 12 on the collection vehicle depicted in FIG. 6 and 7, the guide struts **12*a*** have a waved configuration. Because of this, the waste receptacle to be emptied is shaken when the collection vehicle is pushed along under it. This promotes the complete emptying of the waste receptacle into the receiving receptacle.

I claim:

1. Waste collection system comprising a waste receptacle (1) and a collection vehicle (2) suitable for the mechanized emptying thereof, whereby the waste receptacle (1) is suspended from a supporting frame (3) by way of a swivel bearing (22) so as to swivel around a horizontal axis (5), and the collection vehicle (2) includes a catch basin (13) into which the waste receptacle is emptied when it is swiveled out of its upright position, when the collection vehicle drives past said receptacle and guides the catch basin under the waste receptacle, wherein the swivel bearing (22) is allowed to freely swing the waste receptacle through its upright position and the collection vehicle features a tipping mechanism for the waste receptacle (1), which includes a grip element (10) that takes hold of a projection or the rim (11) of the inclined waste receptacle (1) and turns it upside down.

2. Collection vehicle for the mechanized emptying of a waste receptacle (1) suspended from a supporting frame (3)

so as to swivel around a horizontal axis (5), with a swivel mechanism for the waste receptacle (1) that places the waste receptacle (1) in an inclined position, and with a catch basin (13) positioned behind the swivel mechanism in the direction of travel and open at the top, wherein there is a tipping mechanism that includes a grip element (10) that is suitable for taking hold of a projection or the rim (11) of the inclined waste receptacle (1) and turning the waste receptacle upside down, wherein the tipping and swiveling mechanism includes a lift mechanism for lifting a waste receptacle suspended so as to allow lifting.

3. Collection vehicle as claimed in claim 2, wherein the catch basin (13) is connected to a separate collection receptacle (16) by way of a conveyor (15, 15').

4. Collection vehicle as claimed in claim 3, wherein the collection receptacle includes a bag (17) attached to a holding device (18).

5. Collection vehicle as claimed in claim 2, wherein the lift mechanism lifts the waste receptacle suspended in a vertical direction.

6. Collection vehicle as claimed in claim 2, wherein the lift mechanism for the waste receptacle includes a slanted guide track (30) positioned between the swivel projection (9) and the grip element (10).

7. Collection vehicle as claimed in claim 2, wherein the lift mechanism includes a continuous conveyor (45).

8. Collection vehicle for the mechanized emptying of a waste receptacle (1) suspended from a supporting frame (3) so as to swivel around a horizontal axis (5), with a swivel mechanism for the waste receptacle (1) that places the waste receptacle (1) in an inclined position, and with a catch basin (13) positioned behind the swivel mechanism in the direction of travel and open at the top, wherein there is a tipping mechanism that includes a grip element (10) that is suitable for taking hold of a projection or the rim (11) of the inclined waste receptacle (1) and turning the waste receptacle upside down, wherein a shaking mechanism (**12*a***) is provided to shake the upside-down waste receptacle.

* * * * *